US005164779A

United States Patent [19]

Araya et al.

[11] Patent Number: 5,164,779

[45] Date of Patent: Nov. 17, 1992

[54] IMAGE FORMING APPARATUS WITH DUAL VOLTAGE SUPPLIES FOR SELECTIVELY CHARGING AND DISCHARGING AN IMAGE BEARING MEMBER

[75] Inventors: Junji Araya; Noribumi Koitabashi; Shunji Nakamura; Hiromitsu Hirabayashi, all of Yokohama, Japan

[73] Assignee: Canon Kabushiki Kaisha, Tokyo, Japan

[21] Appl. No.: 685,177

[22] Filed: Apr. 15, 1991

Related U.S. Application Data

[63] Continuation of Ser. No. 587,173, Sep. 18, 1990, abandoned, which is a continuation of Ser. No. 478,035, Feb. 9, 1990, abandoned, which is a continuation of Ser. No. 159,917, Feb. 24, 1988, abandoned.

[30] Foreign Application Priority Data

Feb. 26, 1987 [JP] Japan ..... 62-043844
Dec. 11, 1987 [JP] Japan ..... 62-313905

[51] Int. Cl.[5] ..... G03G 15/02
[52] U.S. Cl. ..... 355/219; 361/225
[58] Field of Search ..... 355/210-213, 355/219, 222; 430/902; 361/212, 214, 221, 225, 235

[56] References Cited

U.S. PATENT DOCUMENTS

| | | | |
|---|---|---|---|
| 4,123,154 | 10/1978 | Fisher | 355/15 |
| 4,380,384 | 4/1983 | Ueno et al. | 355/3 CH |
| 4,387,980 | 6/1983 | Ueno et al. | 355/3 CH |
| 4,640,59[illegible] | 2/1987 | Doutney | 355/3 CH |
| 4,657,369 | 4/1987 | Takeuchi | 355/212 |
| 4,851,960 | 7/1990 | Nakamura et al. | 361/225 |

FOREIGN PATENT DOCUMENTS

| | | | |
|---|---|---|---|
| 0035745 | 9/1981 | European Pat. Off. . | |
| 3048141A1 | 9/1981 | Fed. Rep. of Germany . | |
| 3101678A1 | 12/1981 | Fed. Rep. of Germany . | |
| 56-132356 | 10/1981 | Japan . | |
| 56-143459 | 11/1981 | Japan . | |
| 56-146157 | 11/1981 | Japan . | |
| 57-64755 | 4/1982 | Japan | 355/3 CH |
| 58-49960 | 3/1983 | Japan . | |
| 58-54644 | 4/1983 | Japan . | |
| 58-186762 | 10/1983 | Japan . | |
| 60-52870 | 3/1985 | Japan | 355/219 |
| 61-198254 | 9/1986 | Japan | 355/3 CH |

*Primary Examiner*—Joan H. Pendegrass
*Attorney, Agent, or Firm*—Fitzpatrick, Cella, Harper & Scinto

[57] ABSTRACT

An image forming apparatus includes a charger for charging an image bearing member. The charger includes a charging member contacted to the image bearing member and supplied with a voltage. The charger functions both as discharging device and charging device by switching a voltage applied thereto. The apparatus is made smaller, simpler and less expensive in cost.

79 Claims, 7 Drawing Sheets

IMAGE FORMING APPARATUS WITH DUAL VOLTAGE SUPPLIES FOR SELECTIVELY CHARGING AND DISCHARGING AN IMAGE BEARING MEMBER

This application is a continuation of application Ser. No. 07/587,173 filed on Sep. 18, 1990, which is a continuation of application Ser. No. 07/478,035 filed on Feb. 9, 1990, which is a continuation of application Ser. No. 07/159,917 filed on Feb. 24, 1988, all three applications now abandoned.

FIELD OF THE INVENTION AND RELATED ART

The present invention relates to an image forming apparatus such as an image transfer type electrophotographic copying machine or laser beam printer, more particularly to such an apparatus using an image forming process comprising a uniform charging step in which an image bearing member such as a rotatable photosensitive drum and an endless belt is uniformly charged, wherein the image bearing member is repeatedly usable.

Referring first to FIG. 4, there is shown a known transfer type electrophotographic copying machine using a drum type photosensitive member.

The photosensitive drum is indicated by a reference numeral 3 and is rotated at a predetermined peripheral speed in a direction indicated by an arrow about a shaft 3*b*. The photosensitive drum has a conductive layer and a photoconductive layer thereon. During the rotation of the photosensitive drum, it is uniformly charged to the positive or negative polarity by a charger 18, and then the photosensitive drum is exposed to image light L at an exposure station 39 by an unshown image exposure means (slit exposure or a laser beam scanning exposure or the like). By this, an electrostatic latent image is formed corresponding to the light image projected onto the surface of the photosensitive drum.

The electrostatic latent image is developed with toner by a developing device 5, and the toner image is transferred onto a transfer material S which has been transported from an unshown sheet feeding station to between the photosensitive member 3 and the transfer device 13 in a timed relation with the image formed on the photosensitive member.

The transfer material S having received the image, is separated from the photosensitive member surface and then is introduced into an image fixing device where it is subjected to an image fixing operation, so that a copy is produced and is discharged outside the apparatus.

The surface of the photosensitive member 3 is cleaned by a cleaning device 6, so that the residual toner is removed to be prepared for the next image forming operation. As for the charging device 13 for charging the photosensitive member 3, a known corona charging device having a wire electrode is widely used.

Such a corona charging device is used also for pre-exposure, by which the surface of the photosensitive member 3 is uniformly discharged before the repetitively usable photosensitive member is uniformly charged prior to the image exposure. After the image forming operation, a whole surface exposure step is required to remove the remaining potential by exposing the photosensitive member to uniform light.

More particularly, in order to repetitively use the photosensitive member 3, the potential contrast by the previous latent image remaining on the photosensitive member 3 is required to be dissipated before the next charging step. Otherwise if the photosensitive member is charged without dissipating the potential contrast of the previous latent image, the surface of the photosensitive member is not uniformly charged when it is charged by a corona charging device, with the result that the potential contrast of the previous electrostatic latent image remains and appears in the next image as a ghost image.

Also, it is required that after the image forming operation, the apparatus is stopped after the potential on the photosensitive member 3 is dissipated, since otherwise the sensitivity, or the like, of photosensitive member may, vary during the rest period.

In the apparatus of FIG. 4, a whole surface exposure device (eraser) 19 is disposed between the charging device 18 and the cleaning device 6 to discharge the photosensitive member 3 for the above described purpose. Since the photosensitive member 3 is subjected to the whole exposure operation by the whole surface exposure device 19 before it is charged by the charging device in each of the image forming cycle in the repetitive image forming cycles, and therefore, the surface of the photosensitive member can be uniformly charged by the charging device 18. After the image forming operation, the charging device 18 is stopped, and then the photosensitive member 3 is rotated through one full turn (post-rotation), during which, the entire surface of the photosensitive member is exposed to the uniform light by the whole surface exposure device 19, so that the entire surface of the photosensitive member is electrically discharged, and only then the rotation of the photosensitive member is stopped.

However, the provision of the whole surface exposure device 19 makes the apparatus bulky and complicated.

Further, when the charging is performed by a corona discharging device, a high voltage such as several KV has to be applied to its wire electrode, and the discharging device itself becomes bulky since the distance must be maintained large between the wire electrode and the shield electrode to prevent leakage to the shield electrode or the body of the discharging device. Additionally, the corona discharge produces ozone which influences the apparatus or deteriorates the photosensitive member, resulting in a blurred image.

In view of the above, it is now considered that the corona discharger having the above described problems is not used, but a contact type charging means is used by which a charging member is contacted to the photosensitive member to charge it. By doing so, the problem of the high voltage application and the problem of the production of ozone can be solved. The contact type charging device is such that a conductive member such as a conductive fiber brush or a conductive and elastic roller is contacted to the surface of the photosensitive member with a DC voltage of the order of 1 KV or superimposed DC voltage and AC voltage applied to the conductive member, by which the surface of the photosensitive member is charged to a desired potential.

Where, however, the contact type charger is used, the surface of the photosensitive member is not charged uniformly, but spot-like nonuniformity results. The inventors have proposed in U.S. Ser. No. 131,585, U.S. Pat. No. 4,851,960, that a vibrating voltage such as an alternating voltage having a peak-to-peak voltage which is larger than twice the absolute value of the charge starting voltage to the photosensitive member is applied to the charging member, whereby the photosensitive member is uniformly charged. The present invention is a further improvement where such a contact type charging member is incorporated into an image forming apparatus.

SUMMARY OF THE INVENTION

Accordingly, it is a principal object of the present invention to provide an image forming apparatus using a contact type charger.

It is another object of the present invention to provide a image forming apparatus which is small in size, simple in structure and/or low in cost.

It is a further object of the present invention to provide an image forming apparatus provided with a charging device which does not require a high voltage as in a corona discharger having a wire electrode, which has a high efficiency and which produces a relatively small amount of ozone when it charges or discharges a member.

It is a further object of the present invention to provide an image forming apparatus provided with a contact type charging means, in which an image bearing member is uniformly and stably charged, so that a good image can be produced.

The invention in one aspect pertains to an image forming apparatus comprising a moveable image bearing member on which an image is repetitively formed and means for forming an image on the image bearing member. The image forming means includes means for charging the image bearing member, which includes a charging member contacted to the image bearing member and means for applying first and second vibratory voltages to the charging means. The charging means also functions as means for electrically discharging the image bearing member. When it charges the image bearing member, the voltage applying means applies to the charging member a first vibratory voltage. When it functions as the discharging means, the voltage applying means applies to the charging member a second vibratory voltage having a center of vibration whose absolute value is smaller than that of a center of vibration in the first voltage.

With respect to another aspect of the invention, a peak-to-peak voltage of each of the vibratory voltages applied to the charging member is not less than twice an absolute value of a charge starting voltage image bearing member.

According to a further aspect of the invention, the image bearing member is a photosensitive member and the image forming means includes exposure means for exposing the photosensitive member to image information light. An absolute value of the center of vibration of the second vibratory voltage is set to be less than an absolute value of the a saturated potential which is a potential saturated as a result of attenuation of a charged photosensitive member when exposed to light.

Yet another aspect of the invention is the feature of a means for selecting between the first and second voltage applying means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
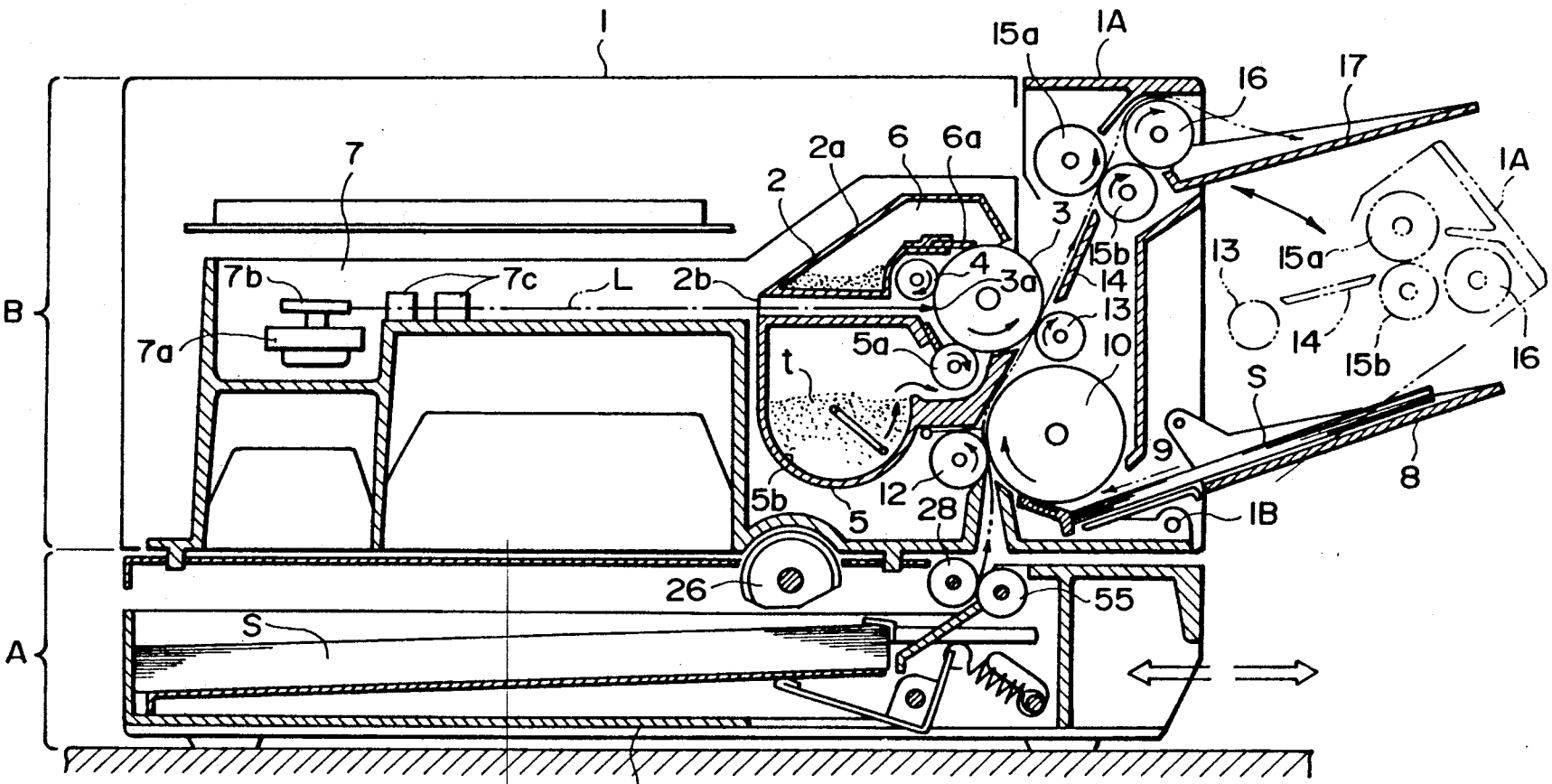
FIG. 1 is a sectional view of a laser beam printer according to an embodiment of the present invention.

Referring to FIG. 1, there is shown an image forming apparatus (a laser beam printer) according to an embodiment of the present invention. The image forming apparatus comprises a sheet feeding station A and a laser beam printing station B in combination.

First, the structure of the printer station B will be described. The printer station B is provided with an outer casing 1. The front side of the apparatus is shown in this Figure as the right-hand side. The outer casing 1 includes a front plate 1A which is pivotable about a hinge 1B disposed at a bottom portion, so that the front plate 1A may be opened as shown by chain lines or closed as shown by solid lines in this Figure. When the printer station B is serviced or when a process cartridge 2 is mounted into or dismounted from the main assembly of the printer, the front plate 1A is opened to allow wide access to the inside thereof.

The process cartridge 2 in this embodiment includes a cartridge housing **2*a* and contains therein a photosensitive drum 3, a charging roller 4, a developing device 5 and a cleaner 6 as image forming process means. It is detachably mountable into the printer casing 1 at a predetermined accommodating position when the front plate 1A is opened as shown by chain lines. The present invention is conveniently usable when the process cartridge 2 contains at least a photosensitive drum 3 (an image bearing member) and a charging roller 4 (charging member). However, one of the photosensitive drum 3 and the charging roller 4 may be substantially permanently fixed in the main assembly of the apparatus. In any event, the present invention is applicable where the developing device 5 or the cleaning 6 is not contained in the cartridge 2 or where another process means is contained in the cartridge. When the process cartridge 2** is mounted correctly at the predetermined position in the printer, mechanical and electrical couplings are established by coupling members (not shown) between the mechanical driving systems and electrical circuit systems between the cartridge side and the main assembly side.

The outer casing 1 contains a laser beam scanner 7 disposed at a rear side therein, and the laser beam scanner 7 includes a semiconductor laser, a scanner motor 7*a*, a rotatable scanning mirror 7*b* such as a polygonal mirror, a lens system 7*c* and others. The laser beam L from the scanner 7 travels substantially horizontally through an exposure window 2*b* of the cartridge housing 2*a* of the cartridge mounted therein, the laser beam L further travels between the cleaner 6 and the developing device 5 disposed at upper and lower sides, respectively. It reaches the left side of the photosensitive drum 3 at the exposure station 3*a*. By the rotation of the mirror 7*b*, the photosensitive drum 3 surface is scanned in the direction of its generating line and is exposed to the laser beam.

The apparatus further comprises a multi-feeding tray 8 which extends out of the front plate 1A and which is inclined upwardly toward outside. A plurality of sheet materials S can be set therein.

The apparatus further includes a sheet feeding roller 10 disposed at a lower portion inside the front plate 1A, a conveying roller 12 in rolling contact with a left side of the feeding roller 10, an image transfer roller 13 disposed above the feeding roller 10 inside the front plate 1A, a couple of image fixing rollers 15*a* and 15*b* disposed at an upper portion inside the front plate 1A, a sheet guiding plate 14 disposed between the transfer roller 13 and the fixing roller couple 15*a* and 15*b*, a sheet material discharging roller 16 disposed at a sheet outlet side of the fixing roller couple 15*a* and 15*b* and a tray 17 for receiving the sheet materials discharged from the apparatus.

When an image formation start signal is inputted into the control system of the printer, the photosensitive drum 3 is rotated at a predetermined peripheral speed in the clockwise direction as indicated by an arrow. During the rotation, the periphery thereof is uniformly charged to a predetermined polarity, positive or negative by the charging roller 4. The charging roller 4 is of a conductive material to which a predetermined voltage is applied. The photosensitive drum 3 is charged by the roller contacted thereto. The charging roller 4 may be driven by the contact of the photosensitive drum 3 or may be positively rotated in the opposite directions. Also, the charging roller 4 may be non-rotatable. However, it is preferable that the charging roller 4 is positively rotated in the same peripheral direction and at the same peripheral speed as the photosensitive drum 3, or that the charging roller 4 follows the photo-sensitive drum 3 to rotate. This is because then the friction between the roller and the drum is smaller than when there is a peripheral speed difference therebetween, and therefore, the problem of the wear and the scraping or the drum of the roller is reduced.

Then, the surface of the photosensitive drum 3 having been uniformly charged is exposed, at the exposure station 3*a*, to the laser beam L bearing time series picture element signals representing image information to be printed produced by the laser beam scanner 7, so that the photosensitive drum 3 surface is subjected to the main scan operation by the laser beam L in the direction of the generating line of the drum, by which an electrostatic latent image of the image information is formed on the photosensitive drum 3 surface.

The electrostatic latent image thus formed on the photosensitive drum 3 is sequentially developed with a developer carried on a developing sleeve (or roller) 5*a* of the developing device 5 into a toner image. The developing device 5 includes a toner accommodating chamber 5*b* for accommodating the developer (toner). In this embodiment, the latent image is formed by projecting a laser beam spot L at the image area of the surface of the photosensitive drum 3 which has been uniformly charged, so that the charge is removed from the photosensitive drum 3. Therefore, the developing operation is a reversal development by which the developer having the same polarity as the polarity of the charge remained on the photosensitive drum 3, so that the toner is deposited at the portion exposed to the laser beam.

On the other hand, the topmost sheet of the sheets (transfer material) S accommodated in the multi-feeding tray 8 is introduced into the printer by the feeding roller 10 which is rotating in the direction indicated by an arrow. The sheet is conveyed into the nip formed between the feeding roller 10 and the conveying roller 12 and is advanced at a constant speed substantially equal to the peripheral speed of the photosensitive drum into the contact area between the photosensitive drum 3 and the transfer roller 13 constituting a transfer station. The sheet S fed into the transfer station receives the toner image from the surface of the photosensitive drum 3 during its passage between the photosensitive drum 3 and the transfer roller 13 by the function of the voltage of a polarity opposite to that of the toner applied to the transfer roller 13 and the pressure between the transfer roller 13 and the photosensitive drum 3. The application of the voltage to the transfer roller 13 starts when the leading edge of the sheet S reaches the contact portion (transfer portion) between the photosensitive drum 3 and the transfer roller 13. In this embodiment, a transfer roller is employed as the transfer means, however, a corona charger may be used in place thereof.

The transfer sheet S having passed through the transfer portion, is separated from the photosensitive drum 3 surface, and is guided by the guiding plate 14 to the fixing roller couple 15*a* and 15*b*. Of the rollers 15*a* and 15*b*, the roller 15*a* is adapted to be contacted to such a side of the transfer sheet as bears the transferred image and is provided with a halogen heater to constitute a heating roller, whereas the roller 15*b* is adapted to contact the back side of the sheet material and is made of an elastic material to constitute a pressing roller. The sheet material now having the transferred image is fixed while being passed through the nip between the rollers 15*a* and 15*b*, by which the toner image is fixed on the surface of the sheet material by heat and pressure into a permanent image. The sheet is then discharged onto the tray 17 by the discharging roller 16 as a print or copy.

The surface of the photosensitive drum 3 after the toner image is transferred is subjected to the cleaning operation by the cleaner 6 having the cleaning blade 6*a*, so that the residual toner or other contaminations are wiped out to be prepared for the next image forming operation.

In this apparatus, a cassette 40 of the sheet feeding device A is usable in place of the multi-feeding tray 8. When this is used, the topmost sheet material in the cassette 40 is picked up and advanced to the registration rollers 28 and 55 by the pickup roller 26 and is transported to between the feeding roller 10 and the conveying roller 12, in the manner described above.

Figure 2:
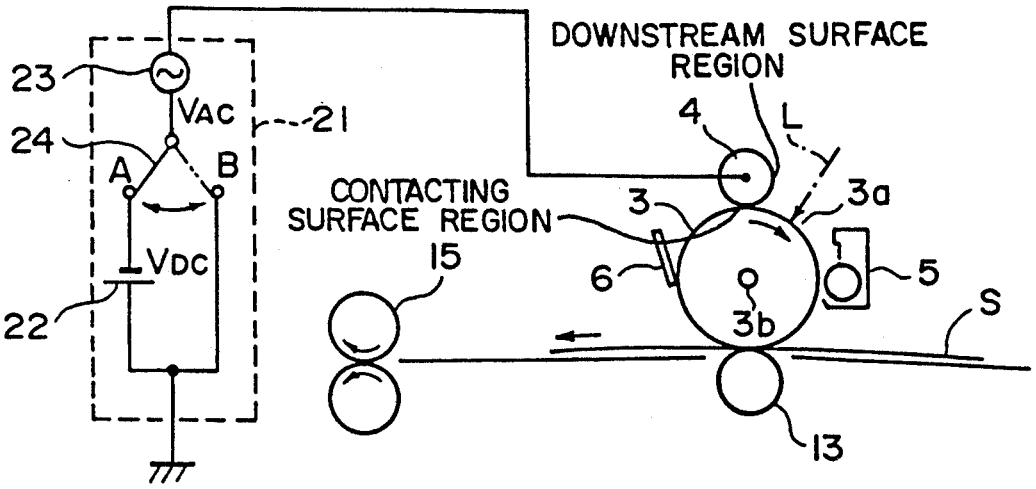
FIG. 2 is a schematic view further illustrating the embodiment of FIG. 1.

Referring to FIG. 2, the apparatus of this embodiment is schematically shown, in which the same reference numerals are assigned to the corresponding elements.

In this embodiment, the photosensitive drum 3 is made of OPC (organic photoconductor), but may be of amorphous silicon, selenium ZnO or other photosensitive material. As described hereinbefore, the charging of the photosensitive member is effected by the charging member contacted to the surface of the photosensitive member.

The charging roller 4 includes a core metal 12 a conductive rubber layer thereon. At least the surface of the charging roller 4 is electrically conductive, and the resistance is $10^2$–$10^8$ ohm preferably. In this embodiment, a conductive urethane rubber roller having the resistance $10^5$ ohm is used. Here, the resistance is the one from the core metal to the roller surface per 1 $cm^2$ of the roller surface area. As the material of the roller, EDDM, NBR and CR are usable. The charging roller 4 is always press-contacted to the surface of the photosensitive member 3 under a predetermined pressure, for example, a line pressure of 0.01–0.2 kg/cm. In this embodiment, the charging roller 4 follows the photosensitive member 3 to rotate.

A voltage application source 21 for the charging roller 4 includes a DC source 22, an AC source 23 and a switch 24. During the pre-rotation period in which the photosensitive member 3 is rotated and during each of the image forming cycles, the switch 24 of the voltage source 21 is contacted to an A side, by which the charging roller 4 is supplied with a vibrating voltage which is a combination of a DC voltage $V_{DC}$ provided by the DC source 23 and an alternating voltage $V_{AC}$ provided by the alternating source 23, so that the charging roller 4 is supplied with a superimposed DC voltage and AC voltage, $V_{DC}+V_{AC}$. Here, the vibrating voltage is a voltage which changes periodically with time. Here, "center of vibration" is defined as (Vmax+Vmin)/2, that is, the middle of the maximum voltage and the minimum voltage in one period. In this embodiment, the DC source produces −700 V DC voltage, whereas the AC source produces an AC voltage $V_{AC}$ having a peak-to-peak voltage Vpp=1500 V and a frequency of 1000 Hz. The waveform of the vibration is in the form of a sine curve.

It should be noted that in this embodiment, there is no whole surface exposure means for uniformly discharging the surface of the photosensitive drum 3.

With this structure, it has been confirmed as a result of repetitive image forming operations that while the potential contrast of the previous electrostatic latent image remains upstream of the charging roller 4 because of the non-existence of the whole surface exposure means, the surface of the photosensitive member immediately downstream of the charging roller 4 is uniformly charged to −700 V despite the non-uniformity of the surface potential before the charging roller 4; and therefore, no ghost image results from the previous electrostatic latent image without the pre-exposure which has been required in the conventional apparatus.

The uniform potential is achieved by the feature of the voltage settings, a charge starting voltage $V_{TH}$ when only a DC voltage is applied to the charging roller and the peak-to-peak voltage Vpp of the AC voltage component satisfy $Vpp \geqq 2|V_{TH}|$.

Figure 10:
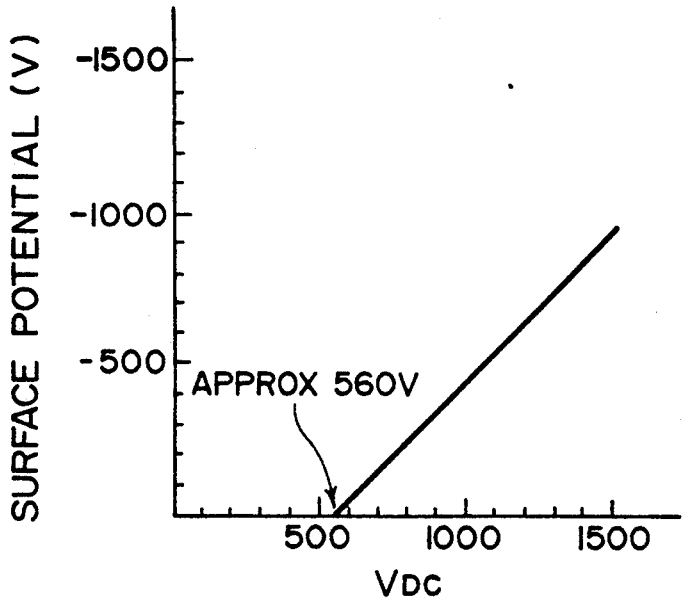
FIGS. 10 and 13 are graphs showing relationships between a DC voltage Vdc and the surface potential of the photosensitive member V when an OPC photosensitive drum and an amorphous silicon photosensitive drum are used, respectively.
Figure 13:
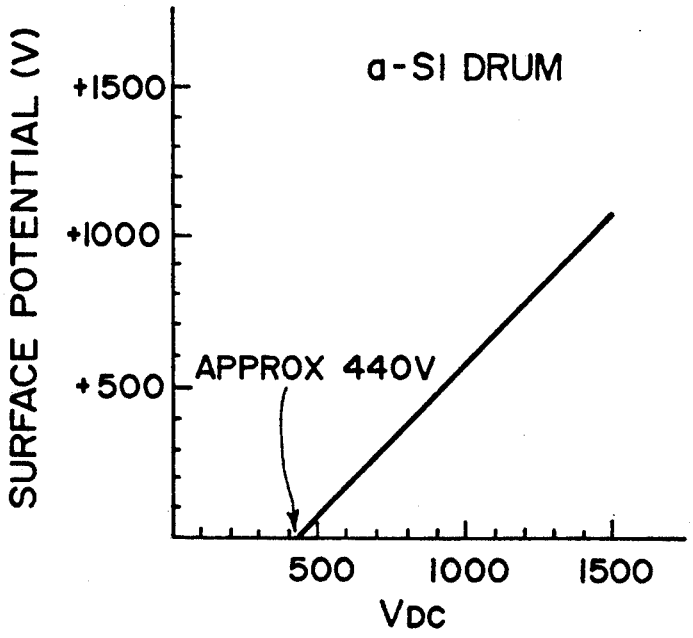

The charge starting voltage is determined in the following manner. Only a DC component is applied to the charging member contacted to the image bearing member (photosensitive member) having a zero surface potential. The voltage of the DC component is gradually increased. The surface potentials of the photosensitive member are plotted with respect to the DC voltage applied thereto with a predetermined increment of the voltage, for example, 100 volts. The first point of the voltage is the one at which the surface potential of the photosensitive member appears, and about ten surface potentials are plotted at each 100 volt increment, for example. Using a least square approximation, a straight line is drawn from the plots. The DC voltage reading at which the straight line and the line representing the zero surface potential is the charge starting voltage. FIGS. 10 and 13 are the graphs produced in the above-described manner.

The requirements of $Vpp \geqq 2|V_{TH}|$ will be explained in detail.

(1) When a DC voltage is applied to the charging roller:

In this case, the photosensitive layer 1*b* of the photosensitive drum includes a CGL (carrier generating layer) of azo pigment and CTL (carrier transfer layer) having a thickness of 19 microns and containing a mixture of hydrazone and resin. The photosensitive layer is an OPC (organic photoconductor) layer of a negative property. The OPC drum is rotationally driven, to the surface of which the charging roller 4 is contacted. The charging roller 4 is supplied with a DC voltage $V_{DC}$ to effect the charging to the OPC photosensitive drum in the dark. The surface potential V of the OPC photosensitive drum 1 charged by the charging roller 4 and the DC voltage $V_{DC}$ applied to the charging roller 4 were measured.

FIG. 10 shows the results of measurements. The charging action involves a threshold concerning the DC voltage $V_{DC}$ applied. The charging effect starts at approximately 560 V. The provided surface potential V by the applied voltage higher than the charge starting voltage is linear with respect to the applied voltage as shown in FIG. 10. The property is substantially immune to ambient conditions, that is, generally the same results are confirmed under high humidity and high temperature conditions (32.5° C. and 85%, for example) and under low humidity and low temperature conditions (15° C. and 10%, for example).

Namely, $Vc = Va - V_{TH}$

Va: DC voltage applied to the charging roller 4;

Vc: potential of the surface of the OPC photosensitive drum;

$V_{TH}$: charge starting voltage.

The equation derives from the Paschen's law.

Figure 11:
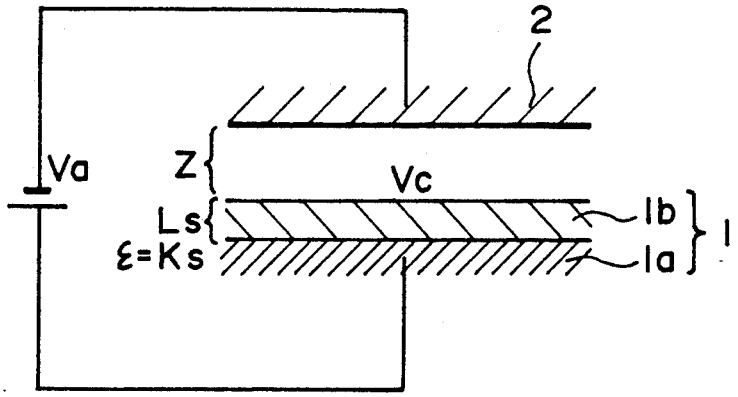
FIG. 11 is a schematic view illustrating a gap between the photosensitive layer and the charging roller.

Referring to FIG. 11 showing a model of microscopic clearances between the surface of the photosensitive drum and the charging roller 4, the voltage Vg across the microscopic gap Z between the OPC photosensitive layer lb and the charging roller 4 is expressed by the following equation:

$$Vg=[(Va-Vc)Z]/(Ls/Ks+Z) \quad (1)$$

Va: applied voltage
Vc: surface potential of the photosensitive layer
Z: gap
Ls: thickness of the photosensitive layer
Ks: dielectric constant of the photosensitive layer On the other hand, the air gap break-down voltage Vb can be expressed by a linear expression of the basis of the Paschen's law where the gap Z is more than 8 microns, as follows.

$$Vb=321+6.2\ Z \quad (2)$$

Figure 12:
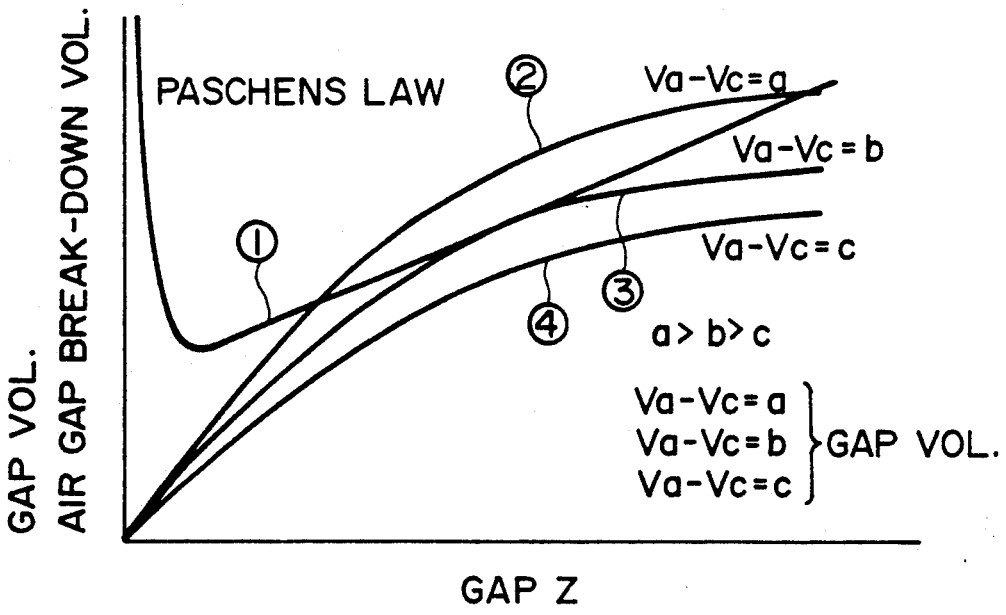
FIG. 12 is a graph showing a relationship between the Paschen's curve and a gap voltage.

The equations (1) and (2) are plotted on a graph in FIG. 12 which shows air gap break-down voltage or gap voltage as a function of the gap Z. In the graph, reference numeral 1 designates a Paschen's curve which is convex-down, and reference numerals 2, 3 and 4 designate the gap voltages Vg curves which are convex-up with a parameter of Va−Vc.

The electric discharging action occurs when the curves 2, 3 or 4 crosses the Paschen's curve 1. At the point of the discharge start, a discriminant of a quadradic of Z given by Vg=Vb=0, that is, $$Va-Vc-312-6.2\times Ls/Ks)^2=4\times 6.2\times 312\times Ls/Ks$$

That is, $$Vc=Va-(\sqrt{7737.6\times Ls/Ks+312}+6.2\times Ls/Ks)$$

$$(Vc=Va-T_{TH}) \quad (3)$$

When the dielectric constant 3 of the OPC photosensitive layer and the thickness of 19 microns of the CTL layer are substituted into the right side of the equation (3), the following results:

$$Vc=Va-573$$

This is generally the same as the equation obtained from experiments.

Paschen's law, relates to a discharge in the gap. Even in the charging using the charging roller 4, the production of a small amount of ozone is recognized at a position very close to the charging portion (1/100 −1/1000 of the case of corona discharge), so that it is considered that the charging by the charging roller involves a discharge phenomena in one way or another.

FIG. 13 is a graph showing the results of measurements of the DC voltage applied to the charging roller 4 and the surface potential of the photosensitive drum after being charged by the charging roller 4, when the photosensitive layer of the photosensitive drum is replaced by an amorphous silicon photosensitive drum.

To minimize the influence of the dark decay, the experiments were carried out without exposure to light prior to the charging step. The charging starts at $V_{TH}$=approx. 440 V, and with the higher voltage a linear relationship was confirmed like the OPC photosensitive drum case as shown in FIG. 10.

When Ks=12 and Ls=20 microns of an amorphous silicon photosensitive drum are substituted for Ks and Ls of the equation (3), $V_{TH}$=432 V, which is substantially the same as results of experiments.

When a DC voltage is applied to a charging roller 4, the surface of the photosensitive member is charged with the properties described above. When the electrostatic pattern resulted is visualized by a known developing method, a spotty pattern results due to the spotty charging.

For the purpose of eliminating the non-uniformness of the charging, the inventors applied a vibratory voltage provided by a DC voltage and an AC voltage superposed therewith to the charging roller. As a result, it has been found that it is effective for elimination of the non-uniformness by superposing the DC voltage and AC voltage having a certain level of peak-to-peak voltage.

This will be explained in detail.

(2) When a vibratory voltage provided by superposed DC and AC voltage to the charging roller:

The OPC photosensitive drum and amorphous silicon photosensitive drum are the same as the ones used in paragraph (1).

A vibratory voltage ($V_{DC}+V_{AC}$) provided by superposing a DC voltage $V_{DC}$ and an AC voltage $V_{AC}$ having a peak-to-peak voltage Vp−p is applied to the charging roller 4 to contact-charge the amorphous silicon and OPC photosensitive drum, respectively. The peak-to-peak voltage and the charged potential of the surface of the photosensitive drum were measured.

Figure 9:
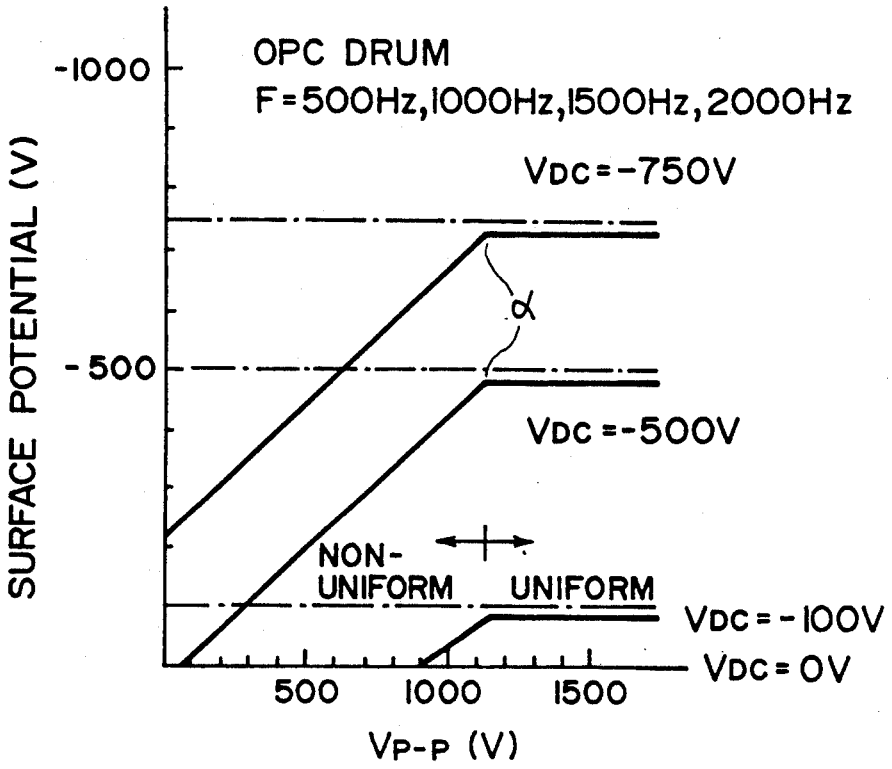
FIGS. 9 and 14 are graphs showing relationships between a peak-to-peak voltage Vpp of the applied voltage and the surface potential V of the photosensitive member when an OPC photosensitive drum and an amorphous silicon photosensitive drum is used, respectively.
Figure 14:
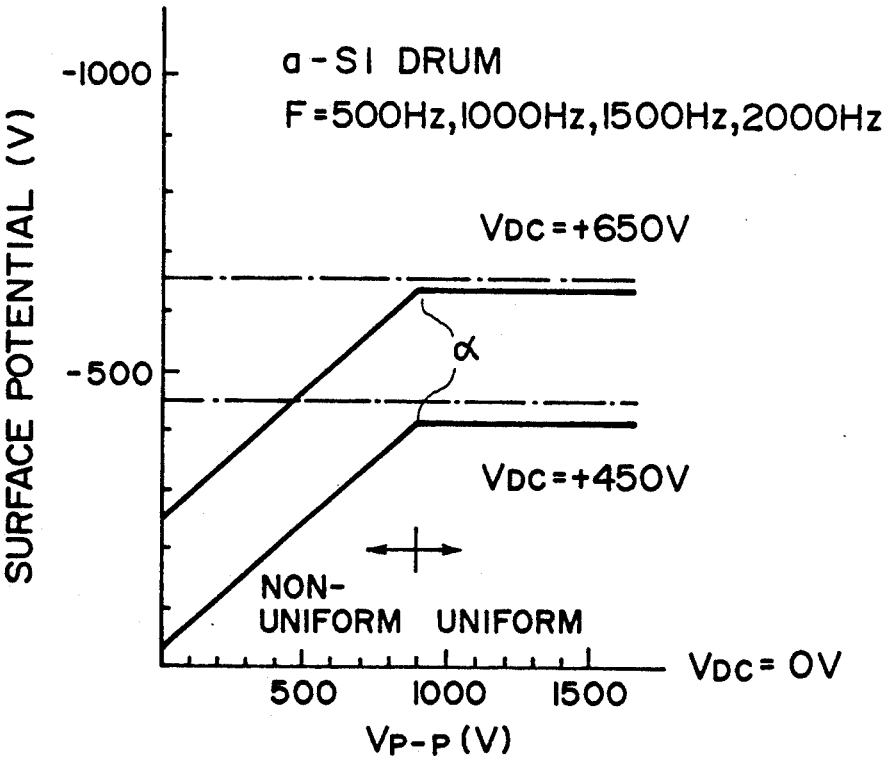

FIGS. 9 and 14 show the results.

In the area of small Vp−p, the potential increases substantially linearly proportionally with Vp−p. When it is beyond a certain level, the potential levels of substantially at the $V_{DC}$ level of the DC component of the applied voltage and becomes substantially constant irrespective of increase of Vp−p.

The inflection point α with respect to Vp−p is approx. 1100 V as shown in FIG. 9 in the case of OPC photosensitive drum, and approx. 900 V in the case of the amorphous silicon drum as shown in FIG. 14. These are approximately twice the charge starting voltage $V_{TH}$ when the DC voltage is applied (paragraph (1)).

Even if the frequency of the AC voltage and the voltage level $V_{DC}$ of the DC component of the applied voltage are changed, the position of the inflection point α with respect to Vp−p is constant, although the level-off point of the charged potential changes with the variation of $V_{DC}$. Also, the results shown in FIGS. 9 and 14 remain unchanged even when the frequency of the applied voltage is changed to 500 Hz, 1000 Hz, 1500 Hz and 2000 Hz.

The surface of the photosensitive drum charged by the charging roller supplied by the superposed DC component.

When the level of Vp−p is small, that is, when there is a linear relationship between Vp−p/2 and the charged potential (inclination is 1), a spotty charging results like when a DC voltage alone is applied to the charging roller 4. However, where the peak-to-peak voltage higher than the inflection point α is applied, the charged potential level is constant, and the resultant visualized image is uniform, that is, the charging is uniform.

That is, in order to obtain uniform charging, it is preferable to apply between the photosensitive member and the charging roller a vibratory voltage having a peak-to-peak voltage which is not less than the absolute value of the charge starting voltage $V_{TH}$ when a DC voltage determined on the basis of the various properties, or the like, of the photosensitive member which is a member to be charged. The surface potential of the photosensitive member provided is dependent on the DC component of the voltage applied.

The relationship among the uniformness of the charging, the peak-to-peak voltage Vp−p of the vibratory voltage and the charge starting voltage $V_{TH}$, more particularly, the uniform charging is provided when $Vp-p \geqq 2\ V_{TH}$ is exemplarily confirmed. This is theoretically supported as follows.

With respect to the relation between the surface potential and the Vp−p change, the inflection point $\alpha$ is considered to be a starting point where the electric charge starts to transfer back from the photosensitive member to the charging roller under the vibratory field between the photosensitive member and the charging roller, provided by the vibratory voltage application.

Figure 6:
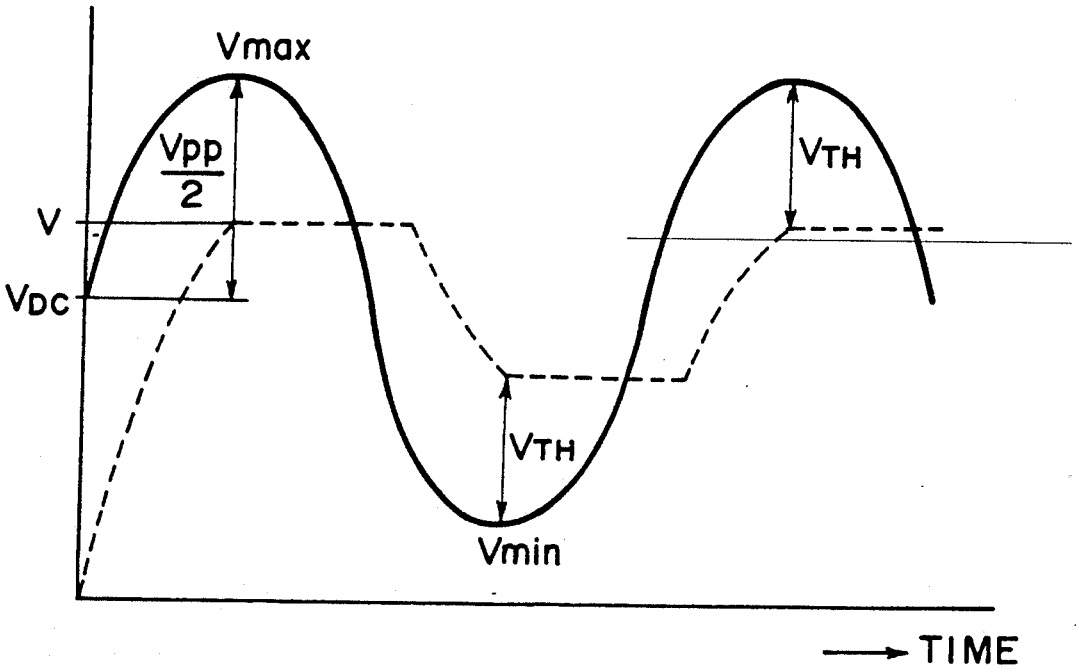
FIGS. 6 and 7 are graphs illustrating vibration of the charge potential of the photosensitive drum in the area where the charging roller and the photosensitive drum are cross to each other.

FIG. 6 shows a waveform of the applied voltage to the charging roller in the area where the charging roller is close to the photosensitive member (solid line) and the surface potential of the photosensitive member (broken lines). For the sake of simplicity, it is assumed that the vibratory voltage waveform is such that a DC component $V_{DC}$ and an AC component Vp−p of a sine wave, the Vmax and Vmin of the vibratory voltage are expressed as follows:

$$Vmax = V_{DC} + Vp-p/2$$

$$Vmin = V_{DC} - Vp-p/2.$$

When the voltage of Vmax is applied, the photosensitive member, by the equation $Vc = Va - V_{TH}$, is charged to the following surface potential:

$$V = V_{DC} + Vp-p/2 - V_{TH}.$$

In the process of the applied voltage to the charging roller relative to the surface potential approaching the minimum Vmin, when the potential difference becomes beyond the charge starting voltage $V_{TH}$, the excessive charge on the photosensitive member is transferred back to the charging roller.

The fact that the transfer and the back transfer of the charge between the charging roller and the photosensitive roller are carried out under the existence of the threshold $V_{TH}$, means that the transfer of the charge therebetween is determined on the basis of the gap voltage, and therefore, the charge transfer is directionally equivalent.

For this reason, in order that the back transfer occurs, the following is to be satisfied:

$$(V_{DC} + Vp-p/2 - V_{TH}) - (V_{DC} - Vp-p/2) \geqq V_{TH}$$

That is, $$Vp-p \geqq -2V_{TH}$$

This agrees the above described experimental equation.

In other words, even if excessive charge is deposited locally on the photosensitive member to provide a high potential, the back transition of the charge make the potential uniform. On the contrary, even if no charge is deposited locally, the transition of the charge makes the potential uniform.

By the formation of the vibratory electric field by the vibratory voltage between the charging roller and the photosensitive member, the charge transfers and transfers back therebetween, wherein the charge transfer is dependent on the threshold $V_{TH}$. If it is assumed that the charge movement occurs when a potential difference not less than the threshold $V_{TH}$ in a certain determined distance, in the area where the charging roller and the photosensitive drum are close to each other, the charge potential of the photosensitive drum vibrates in the manner shown in FIG. 6 by broken line, which is similar to a pulse wave. As seen from the Figure, the amplitude is $Vp-p/2 - V_{TH}$.

Figure 8:
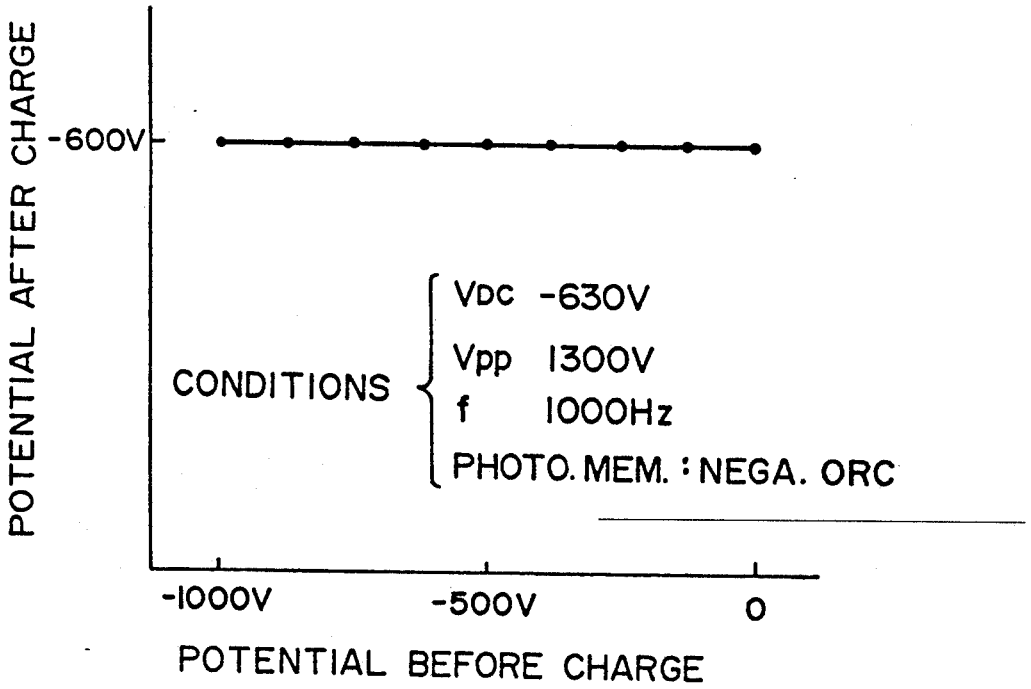
FIG. 8 is a graph showing a relationship between the potential of the photosensitive drum prior to the charging and that after the charging.

In FIG. 6, before the potential of the charging roller 4 reaches from $V_{DC}$ (applied DC voltage) to Vmax, the difference between the initially applied voltage to the charging roller and the surface potential of the photosensitive member is larger than $V_{TH}$. Therefore, the transition of the charge occurs until the potential differences reaches $V_{TH}$, so that the surface potential of the photosensitive member increases. After the voltage reaches Vmax, the potential difference between the applied voltage and the surface potential of the photosensitive member becomes smaller than $V_{TH}$, so that no charge transition occurs between the charging roller 4 and the photosensitive member, and therefore, the surface potential of the photosensitive member is maintained. When the applied voltage further reduces, approaching Vmin, the difference between the applied voltage and the surface potential of the photosensitive member becomes larger than $V_{TH}$. Then, the back transition of the charge from the photosensitive member to the charging roller occurs, so that it approaches $V_{TH}$. When the applied voltage becomes Vmin, and the difference between the applied voltage and the surface potential of the photosensitive member becomes $V_{TH}$, the charge transition does not occur. By repeating those actions, the surface potential of the photosensitive member vibrates in the waveform somewhat like a pulse wave as shown by broken lines having an amplitude of $(Vpp/2 - V_{TH})$. Here, because of its definition the threshold voltage $V_{TH}$ is the potential difference in the closest portion where the charge transition occurs, and is dependent on the distance. More particularly, the threshold voltage $V_{TH}$ required for the charge to transit increases with a gap between the charging roller 4 and the photosensitive member. This is supported by the Paschen's low shown in FIG. 12 wherein the air gap break-down voltage increases with the distance. Therefore, in the structure wherein the distance between the charging roller and the photosensitive member increases toward the downstream side of the photosensitive member with respect to its peripheral movement, the surface potential of the photosensitive member having vibrated in the somewhat pulse-like waveform having an amplitude of $(Vpp/2 - V_{TH})$ converges to zero in its amplitude together with increase of the threshold voltage $V_{TH}$, in the distance increasing period. In the area where they are spaced apart with a distance sufficient to suppress the transition or back transition of the charge, the surface potential of the photosensitive member surface is substantially equal to the DC voltage component, i.e. $V_{DC}$. Therefore, even if the potential contrast by the previous latent image remains on the photosensitive member, the surface of the photosensitive member is uniformly charged irrespective of the previous potential, by charging the photosensitive member by the charging roller. This will be understood from FIG. 8, if the comparison is made between when the potential before the charging and the potential after the charging in the case where the OPC photosensitive drum is charged by the charging roller.

Figure 7:
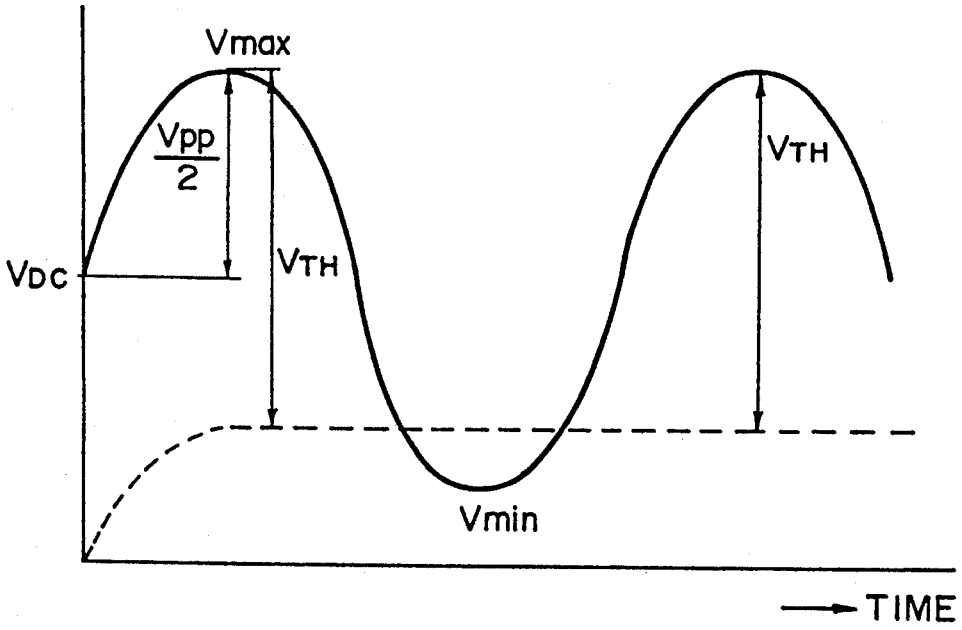

If, however, the charge starting voltage $V_{TH}$ and the peak-to-peak voltage Vpp of the AC component satisfy $Vpp \leqq 2|V_{TH}|$, when the applied voltage to the charging roller exceeds Vmax, as shown in FIG. 7, the difference between the applied voltage and the surface potential of the photosensitive member does not exceed the voltage $V_{TH}$, so that no charge transition occurs. As a result the surface potential of the photosensitive member becomes smaller than the DC component voltage $V_{DC}$. Therefore, even if it is attempted to charge the surface of the photosensitive member to $V_{DC}$, the resulting surface potential becomes smaller than that. From this standpoint, $Vpp \geqq 2|V_{TH}|$ is preferable.

By way of explanation, when the photosensitive member is charged only by the DC voltage, the surface potential of the photosensitive member reaches −700 V when a DC voltage of −1200 to −1300 V is applied, but the uniformity of the charge is not good. And, when the photosensitive member 1 is repeatedly used, the potential contrast in the previous electrostatic latent image remains with the result of ghost image produced.

On the other hand, after the photosensitive member 3 is repeatedly used for image formation, and the repeated image formations are completed, it is desired that the surface of the photosensitive member 3 is electrically discharged to make it suitable for resting. To accomplish this, only an AC component is applied to the charging roller 4 with the DC component being zero. More particularly, after completion of the image forming operation, the switch 24 of the power source 21 is switched to contact B and is maintained, during the post-rotation which continues at least one full turn of the photosensitive member. In the system according to this embodiment wherein the charging member is contacted to the image bearing member to charge it, the voltage applied to the charging member is small, so that the switching is easier than when a corona discharging device requiring a high voltage is used. By the switching, the voltage applied to the charging roller 4 switches from the superposed AC and DC voltage to an AC voltage $V_{AC}$ only. In other words, the center of the vibration changes from $V_{DC}$ to zero, in the photosensitive member discharging operation. When the DC component of the applied voltage to the charging roller 4 is zero, and only AC voltage component is supplied, the surface potential of the photosensitive member 3 becomes uniformly zero substantially. It has been confirmed that the surface of the photosensitive member is discharged similarly when the frequency of the AC component is 500 Hz, 1000 Hz, 1500 Hz and 2000 Hz. As described hereinbefore, when the absolute value of the charge starting voltage is not less than twice the peak-to-peak voltage of the vibrating voltage, the surface potential of the photosensitive member becomes substantially equal to the voltage of the DC component applied, and therefore, it is preferable that $Vpp \geqq 2|V_{TH}|$ is satisfied. This is understood from the graph of FIG. 9 illustrating the relationship between Vpp and the surface potential of the photosensitive member. It is desirable that the AC voltage component is not changed when the photosensitive member discharging operation is effected since then the structure of the apparatus is simple. However, it may be changed as long as $Vpp \geqq 2|V_{TH}|$ satisfied. However, if it is satisfactory that the surface potential of the photosensitive member does not reach 0 V upon the discharging operation and/or that a relatively small nonuniformity remains, $Vpp < 2|V_{TH}|$ is satisfactory.

The photosensitive member discharging operation continues for at least one full turn of the photosensitive member, so that the entire surface of the photosensitive member 3 is electrically discharged. Thereafter, the AC voltage is shut, and the rotation of the photosensitive member 3 is stopped.

In this embodiment, the potential remaining on the photosensitive member is attenuated before the apparatus is stopped or it is put into stand-by state, after the image forming operation using the photosensitive member is repeated. To do this, the voltage applied to the charging roller is changed to a vibrating voltage having a center of vibration equal to zero (a pure AC voltage). However, the level of the DC voltage component may be changed from −700 V (image forming operation) to, for example, −100 V upon discharging operation. More particularly, during the post-rotation period after the image forming operation, the charging roller 4 is supplied with a superposed voltage of a second DC voltage VDC (−100 V) and a sine wave AC voltage $V_{AC}$ having the peak-to-peak voltage of Vpp of 1500 V and the frequency of 1000 Hz. In other words, the center of the vibrating voltage is changed from −700 V to −100 V, and therefore, the absolute value of the center of the vibrating voltage is reduced upon the photosensitive member discharging operation.

By doing so, the surface potential of the photosensitive member 3 reduces to −100 V in its entire surface. It has been confirmed that the same results are provided when the frequency is 500 Hz, 1500 Hz and 2000 Hz. The potential of −100 V is comparable to the potential when the photosensitive member is discharged by the whole surface exposure.

Thereafter, all the voltage applications are stopped, and the rotation of the photosensitive member 3 is stopped. Because of this post-rotation, the property of the photosensitive member does not change even if they are kept rested. As will be understood from the graph of FIG. 9, it is preferable that $Vpp \geqq 1|V_{TH}|$ is satisfied. It is also preferable that the AC voltage upon the photosensitive member discharging operation is the same as that upon the charging operation. However, it may be changed as long as $Vpp \geqq 2|V_{TH}|$ is satisfied.

In the above, the center of the vibratory voltage after the image formation is set −100 V, but it may be changed depending on the photosensitive members used, so that the property of the photosensitive member does not change even if it is kept unused. Preferably, however, the potential is set lower than the potential resulted when the photosensitive member is substantially discharged by exposure to strong light. Here, the potential resulted by the strong exposure is the saturated potential. When a photosensitive member having electric charge is exposed to light, the surface potential thereof attenuates; and the surface potential decreases with the intensity of the light; however, the surface potential does not change at a certain point even if the intensity is increased; and this is called the saturated potential. For usual photosensitive members of various materials, there would be no problem if the absolute value of the center of the vibrating voltage is not more than 100 V.

Figure 3:
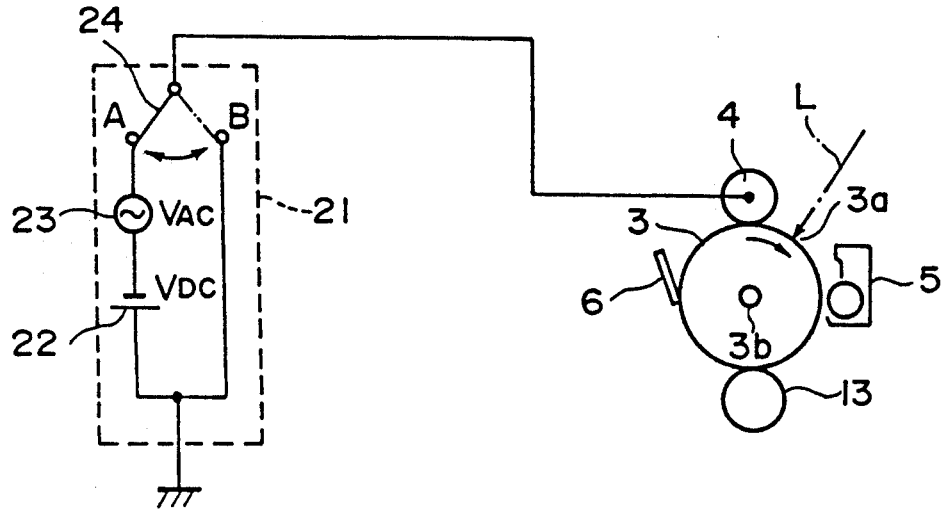
FIG. 3 is a schematic view of an apparatus according to another embodiment.
Figure 4:
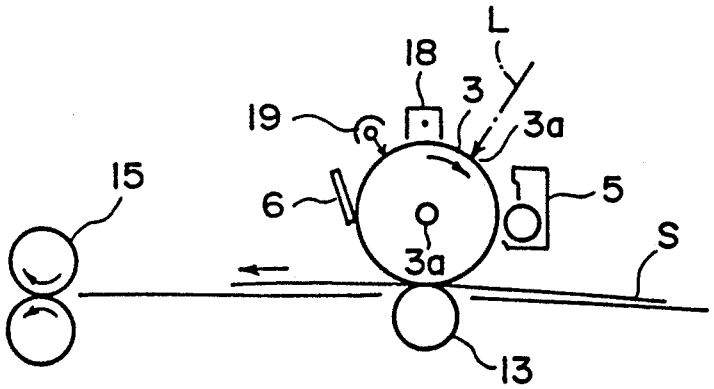
FIG. 4 PRIOR ART
FIG. 4 a schematic view illustrating an example of a conventional apparatus.
Figure 5:
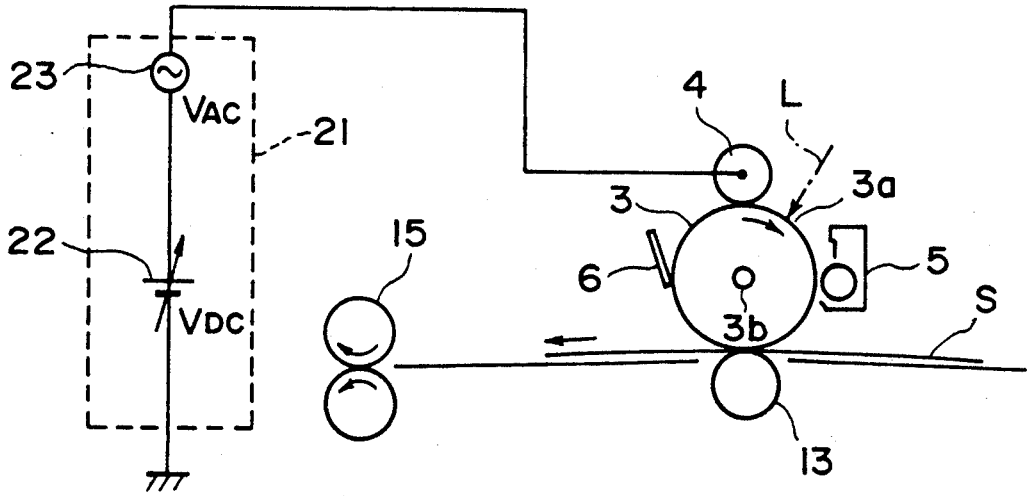
FIG. 5 schematic view illustrating an apparatus according to a further embodiment of the present invention.

Referring to FIG. 3, another embodiment of the present invention will be described, wherein the photosensitive member discharging during the post-rotation of the photosensitive member 3 is effected by switching the potential of the charging roller 4 to the ground potential. During the pre-rotation of the photosensitive member 3 and during the image forming cycle, the switch 24 of the source 21 is maintained at the contact A, whereby the charging roller 4 is supplied with a superposed DC voltage and AC voltage $V_{DC}+V_{AC}$ to uniformly charge the photosensitive member 3, as in FIG. 2 embodiment.

During the post-rotation for at least one full-turn of the photosensitive member after the image forming cycle terminates, the switch 24 is switched to the contact B, that is, the grounded contact, and this is maintained. By this, the charging roller 4 is grounded. By the grounding, the surface potential remaining on the photosensitive 3 is reduced by the charging roller 4, similarly to the case that only the AC voltage is applied to the charging roller 4. The charging effect is weaker than the case where the AC voltage is positively applied. However, the entire surface of the photosensitive member is satisfactorily discharged by setting the number of the post-rotations to be plural. Generally speaking, the photosensitive member 3 is supposed to rotate through plural turns after the image forming operation is completed and before the last transfer sheet S is fixed and discharged. During this plural turns, the photo-sensitive member discharging operation can be performed, by which the photosensitive member 3 is sufficiently uniformly discharged in its entire surface.

In this example, the charging roller is grounded upon the photosensitive member discharging operation. However, the photosensitive member can be discharged by applying a DC voltage having a polarity opposite to that of the potential of the photosensitive member remaining charged. In this case, the resultant surface potential of the photosensitive member is more or less non-uniform.

In the foregoing embodiments, the photosensitive member discharging operation is performed during the post-rotation of the photosensitive drum (image bearing member) after the image forming operation is completed, but it may be performed during the pre-rotation. For example, in the case of a regular development wherein the portion of the photosensitive member corresponding to an image portion of an original is exposed to light after the photosensitive member is uniformly charged; and the charge of the exposed portion is removed; and a developer charged to a polarity opposite to the polarity of the charge is deposited onto the charge remaining portion, it is desirable that a charge does not remain in the non-image area. This is because if the unnecessary portion receives the developer by the remaining charge, the load of the cleaning device or the like is increased. Also, when the transfer material is jammed during an image forming operation, the apparatus stops with the charge remaining on the photosensitive member. If this occurs, it is desirable that the photosensitive member is electrically discharged by at least one full-turn of the photo-sensitive member before the resumption of the image formation, so as to dissipate the charge on the photosensitive member. This may be effected, substantially simultaneously with the main switch of the image forming apparatus being turned on. Also, in the case of the regular development in the repeated image forming cycle, the electric charge is retained on an area of the photosensitive member between the first image and the second image, for example, the charge retaining portion is developed although it is not desired. Therefore, it is preferable to electrically discharge the photosensitive member between adjacent images, in the case of the regular development.

In the foregoing embodiment, the charging roller is in contact with the photosensitive member to charge or discharge the photosensitive member. However, it is possible that a conductive rubber blade used in place of the roller. The blade is somewhat less durable than the roller. However, the blade is advantageous from the standpoint of manufacturing cost.

In the foregoing embodiment, a sine wave used for the waveform of the vibratory voltage, but it may be a pulse wave, a triangular wave or rectangular wave.

Also, the image forming process is not limited to a so-called Carlson process employed in the foregoing embodiments, but the present invention is applicable to various processes known as including a step of uniformly charging the image bearing member. The image exposure means may be of a type wherein an original supporting platen is moved or an original supporting platen is fixed with an optical system movable, and may be of LED array control type, a liquid crystal array control system or other various means.

As described in the foregoing, according to the present invention, the charging means and charge removing means actable on the image bearing member can be one and a common member. When the photosensitive member is discharged, the charging member is supplied with a vibratory voltage having a center of vibration which has an absolute value smaller than the absolute value of the center of vibratory voltage at the time of charging operation, preferably, the vibratory voltage having the center of vibration of zero, it is connected with the ground potential, whereby it is not necessary that pre-discharging means exclusively for the pre-charge and post discharging device exclusively for the post discharge are both employed, whereby the image forming apparatus of this type can be made smaller, simpler and less expensive in cost or the like.

Since the charging means is a charging member supplied with a vibratory voltage contacted to the image bearing member, such a high voltage as has to be employed in a corona discharger for charging and discharging the image bearing member is not required, whereby the charging efficiency is increased, and the production of the ozone is decreased, and the charging and discharging becomes uniform and stabilized.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member on which an image is repetitively formed;

means for forming an image on said image bearing member;

said image forming means including means for charging said image bearing member, which includes a charging member contacted to said image bearing member and means for applying first and second vibratory voltages to said charging member;

wherein said charging means also functions as means for electrically discharging said image bearing member, and wherein when it charges said image bearing member, said voltage applying means applies to said charging member a first vibratory voltage, and when it functions as the discharging means, said voltage applying means applies to said charging member a second vibratory voltage having a center of vibration whose absolute value is smaller than that of a center of vibration of the first voltage.

2. An apparatus according to claim 1, wherein each of the vibratory voltages is provided with superimposition of a DC voltage and an AC voltage.

3. An apparatus according to claim 1, wherein said voltage applying means includes first means for applying, as the first voltage, a superimposed AC and DC voltage to said charging member and second means for applying, as the second voltage, only the AC voltage to said charging member and means for selecting the first and second means, wherein the second means is selected upon said charging means functioning as the discharging means.

4. An apparatus according to claim 3, wherein said selecting means selects said second applying means after said first applying means is selected, and thereafter, the AC voltage applied to said charging member is stopped.

5. An apparatus according to claim 1, wherein said bearing member is electrically discharged by said discharging means during one full rotation of said image bearing member prior to an image forming operation thereon.

6. An apparatus according to claim 5, wherein said image forming means further includes means for forming a latent image corresponding to image information on said image bearing member after said image bearing member is charged by said charging means, and means for effecting a regular development to develop the latent image.

7. An apparatus according to claim 1, wherein said image bearing member is electrically discharged by said discharging means during one full rotation of said image bearing member after an image formation operation thereon.

8. An apparatus according to claim 1, 5 or 7, wherein a peak-to-peak voltage of each of the vibratory voltage applied to said charging member is not less than twice an absolute value of a charge starting voltage of the image bearing member.

9. An apparatus according to claim 1, wherein said charging member includes a surface region contacted to a surface of said image bearing member and another surface region continuous thereto in which said charging member is away from the surface of said image bearing member toward a downstream with respect to movement direction of the surface of said image bearing member.

10. An apparatus according to claim 9, wherein said charging member is in the form of a rotatable roller.

11. An apparatus according to claim 1, wherein said image bearing member is a photosensitive member, and wherein said image forming means includes exposure means for exposing said photosensitive member to image information light.

12. An apparatus according to claim 11, further comprising cleaning means for removing a residual developer from said image bearing member, wherein said charging means is disposed between said cleaning means and said exposure means in a movement direction of said image bearing member.

13. An apparatus according to claim 1, wherein said charging member includes a conductive rubber material.

14. An apparatus according to claim 1, wherein said charging member and said image bearing member are supported in a process cartridge which is detachably mountable into said image forming apparatus.

15. An apparatus according to claim 1, wherein a center of vibration of the second vibratory voltage is zero.

16. An apparatus according to claim 15, wherein the second vibratory voltage is an AC voltage.

17. An image forming apparatus, comprising:

a movable image bearing member on which an image is repetitively formed;

means for forming an image on said image bearing member;

said image forming means including means for charging said image bearing member, which includes a charging member contacted to said image bearing member and means for applying a voltage to said charging means;

wherein said charging means also functions as member for electrically discharging said image bearing member, and wherein said voltage applying means includes a first applying means for applying a first voltage to said charging member upon said image bearing member being charged and a second applying means for applying a second voltage to said charging member upon said image bearing member being electrically discharged, and means for selecting first and second applying means.

18. An apparatus according to claim 17, wherein said first voltage is provided by superimposition of a DC voltage and an AC voltage.

19. An apparatus according to claim 17, wherein said second voltage includes an AC voltage.

20. An apparatus according to claim 18 or 19, wherein each of the voltages are a vibratory voltage, and a peak-to-peak voltage of each of the vibratory voltages applied to said charging member is not less than twice an absolute value of a charge starting voltage of said image bearing member.

21. An apparatus according to claim 19, wherein said second voltage is a constant voltage.

22. An apparatus according to claim 21, wherein charging member is grounded upon said image bearing member being discharged by said second applying means.

23. An apparatus according to claim 17, wherein said image bearing member is a photosensitive member, and wherein said image forming means includes exposure means for exposing said photosensitive member to image information light, said apparatus further comprising cleaning means for removing a residual developer from said image bearing member, wherein said charging means is disposed between said cleaning means and said exposure means in a movement direction of said image bearing member.

24. An apparatus according to claim 17, wherein said first voltage and said second voltages have an AC component, and wherein said first and second means have a common AC voltage source.

25. An apparatus according to claim 17, wherein said charging member is in the form of a rotatable roller.

26. An apparatus according to claim 17, wherein said charging member includes a conductive rubber material.

27. An apparatus according to claim 17, wherein said charging member and said image bearing member are supported in a process cartridge which is detachably mountable into said image forming apparatus.

28. An image forming apparatus, comprising;

a movable image bearing member on which an image is repetitively formed;

means for forming an image on said image bearing member;

said image forming means including means for charging said image bearing member, which includes a charging member contacted to said image bearing member and means for applying first and second vibratory voltages to said charging member;

wherein said charging means also functions as means for electrically discharging said image bearing member, and wherein when it charges said image bearing member, said voltage applying means applies to said charging member a first vibratory voltage, and when it functions as the discharging means, said voltage applying means applies to said charging member a second vibratory voltage having a center of vibration whose value is smaller than that of a center of vibration in the first voltage;

wherein said image bearing member is a photosensitive member, and wherein said image forming means includes exposure means for exposing said photosensitive member to image information light; and, wherein an absolute value of a center of vibration of the second vibratory voltage is set to be less than an absolute value of a saturated potential which is a potential saturated as a result of attenuation of a charged photosensitive member exposed to light.

29. An apparatus according to claim 18, wherein each of the vibratory voltages is provided by means of superimposition of a DC voltage and an AC voltage.

30. An apparatus according to claim 28, wherein said voltage applying means includes first means for applying, as the first voltage, a superimposed AC and DC voltage, and second means for applying, as the second voltage, only an AC voltage, and means for selectively switching said first and second means.

31. An apparatus according to claim 1 or 30, wherein said voltage applying means includes first means for applying the first voltage, second means for applying the second voltage, and means for selectively switching said first and second means, wherein said first and second means has a common AC voltage source.

32. An apparatus according to claim 3 or 30, wherein said first and second means has a common AC voltage source.

33. An apparatus according to claim 28, wherein said image bearing member is electrically discharged by said discharging means at least during one full rotation of said image bearing member prior to an image forming operation thereon.

34. An apparatus according to claim 28, wherein said image bearing member is electrically discharged by said discharging means at least during one full rotation of said image bearing member after an image formation operation thereon.

35. An apparatus according to claim 28, wherein a peak-to-peak voltage of each of the vibratory voltages applied to said charging member is not less than twice an absolute value of a charge starting voltage of said image bearing member.

36. An apparatus according to claim 28, wherein said charging member is in the form of a rotatable roller.

37. An apparatus according to claim 28, wherein said charging member comprises a conductive rubber material.

38. An apparatus according to claim 28, wherein said charging member and said image bearing member are supported in a process cartridge which is detachably mountable into said image forming apparatus.

39. An apparatus according to claim 28, further comprising cleaning means for removing a residual developer from said image bearing member, wherein said charging means is disposed between said cleaning means and said exposure means in a movement direction of said image bearing member.

40. An image forming apparatus, comprising:

a movable image bearing member on which an image is repetitively formed;

means for forming an image on said image bearing member;

said image forming means including means for charging said image bearing member, which includes a charging member contacted to said image bearing member and means for applying first and second vibratory voltages to said charging member;

wherein said charging means also functions as means for electrically discharging said image bearing member, and wherein when it charges said image bearing member, said voltage applying means applies to said charging member a first vibratory voltage, and when it functions as the discharging means, said voltage applying means applies to said charging member a second vibratory voltage having a center of vibration whose absolute value is smaller than that of a center of vibration in the first voltage; and, wherein a peak-to-peak voltage of each of the vibratory voltage applied to said charging member is not less than twice an absolute value of a charge starting voltage of said image bearing member.

41. An apparatus according to claim 40, wherein each of the vibratory voltages is provided means of superimposition of a DC voltage and an AC voltage.

42. An apparatus according to claim 41, wherein said voltage applying means includes first means for applying the first voltage, second means for applying the second voltage, and means for selectively switching said first and second means, wherein said first and second means has a common AC voltage.

43. An apparatus according to claim 40, wherein said voltage applying means includes first means for applying, as the first voltage, a superimposed AC and DC voltage, and second means for applying, as the second voltage, only an AC voltage, and means for selectively switching said first and second means.

44. An apparatus according to claim 43, wherein said first and second means has a common AC voltage source.

45. An apparatus according to claim 30 or 43, wherein the Ac voltage applied to said charging member is stopped, after said second applying means is selected.

46. An apparatus according to claim 40, wherein said image bearing member is electrically discharged by said discharging means at least one full rotation of said image bearing member prior to an image forming operation thereon.

47. An apparatus according to claim 40, wherein said image bearing member is electrically discharged by said discharging means at least during one full rotation of said image bearing member after an image formation operation thereon.

48. An apparatus according to claim 40, wherein said charging member is in the form of a rotatable roller.

49. An apparatus according to claim 40, wherein said charging member comprises a conductive rubber material.

50. An apparatus according to claim 40, wherein said charging member and said image bearing member are supported in a process cartridge which is detachably mountable into said image forming apparatus.

51. An apparatus according to claim 40, wherein said image bearing member is a photosensitive member, and wherein said image forming means includes exposure means for exposing said photosensitive member to image information light, said apparatus further comprising cleaning means for removing a residual developer from said image bearing member, wherein said charging means is disposed between said cleaning means and said exposure mean sin a movement direction of said image bearing member.

52. An apparatus according to claim 1, 28, or 40, wherein a center of the second voltage has the same polarity as that of the first voltage.

53. An image forming apparatus, comprising:

a movable image bearing member on which an image is repetitively formed;

means for forming an image on said image bearing member;

said image forming means including means for charging said image bearing member, which includes a charging member contacted to said image bearing member and means for applying a voltage to said charging member;

wherein said charging means also functions as means for electrically discharging said image bearing member, and wherein said voltage applying means includes a first applying means for applying a first voltage to said charging member upon said image bearing member being charged and a second applying means for applying a second voltage to said charging member upon said image bearing member being electrically discharged, and means for selecting first and second applying means; and wherein each of the voltages is a vibratory voltage, and a peak-to-peak voltage of each of the vibratory voltages applies to said charging member is not less than twice an absolute value of a charge starting voltage of said image bearing member.

54. An apparatus according to claim 53, wherein said first voltage and said second voltages have an AC component, and wherein said first and second means have a common Ac voltage source.

55. An apparatus according to claim 53, wherein said first voltage is provided by superimposition of a DC voltage and an AC voltage.

56. An apparatus according to claim 53, wherein said second voltage includes an AC voltage.

57. An apparatus according to claim 53, wherein said second voltage is a constant voltage.

58. An apparatus according to claim 57, wherein charging member is grounded upon said image bearing member being discharged by said second applying means.

59. An apparatus according to claim 53, wherein said image bearing member is a photosensitive member, and wherein said image forming means includes exposure means for exposing said photosensitive member to image information light, said apparatus further comprising cleaning means for removing a residual developer from said image bearing member, wherein said charging means is disposed between said cleaning means and said exposure means in a movement direction of said image bearing member.

60. An apparatus according to claim 11, 23, 28, 39, 51, or 59 wherein said image bearing member has an organic photoconductive layer.

61. An apparatus according to claim 11, 23, 28, 39, 51, or 59, wherein said image bearing member has an amorphous silicon photosensitive layer.

62. An apparatus according to claims 11, 23, 28, 39, 51 or 59, wherein said image bearing member is not exposed to light before it is charged by said charging means, after the image is transferred from said image bearing member to the transfer material.

63. A process cartridge detachably mountable to an image forming apparatus, comprising:

a movable image bearing member on which an image is repetitively formed;

a charging member contactable to said image bearing member to charge said image bearing member to form an image thereon, said charging member being supplied with first and second vibratory voltages;

wherein said charging member also functions as a discharging member for discharging said image bearing member, and when said charging member charges said image bearing member, said charging member is supplied with the first vibratory voltage, and when said charging member functions as the discharging member, said charging member is supplied with a second vibratory voltage having a center of vibration with an absolute value which is smaller than an absolute value of a center of vibration of the first vibratory voltage.

64. A cartridge according to claim 63, wherein each of the vibratory voltages is provided with superimposition of a DC voltage and an AC voltage.

65. A cartridge according to claim 63, wherein the first vibratory voltage is a DC-biased AC voltage, and the second voltage is a non-DC-biased AC voltage, and the first and second vibratory voltages are selectively supplied to said charging member.

66. A cartridge according to claim 63, wherein said image bearing member is discharged by said charging member through at least one full rotation of said image bearing member prior to an image forming operation.

67. A cartridge according to claim 63, wherein said image bearing member is discharged by said charging member through at least one full rotation of said image bearing member after an image forming operation.

68. A cartridge according to claim 63, wherein a peak-to-peak voltage of each of the vibratory voltages applied to said charging member is not less than twice an absolute value of a charge starting voltage of said image bearing member.

69. A cartridge according to claim 63, wherein said charging member includes a surface region contacted to a surface of said image bearing member and another surface region continuous thereto in which said charging member is away from the surface of said image bearing member in a downstream direction with respect to a movement direction of the surface of said image bearing member.

70. A cartridge according to claim 69, wherein said charging member is in the form of a roller.

71. A cartridge according to claim 63, wherein said image bearing member is a photosensitive member.

72. A cartridge according to claim 71, wherein said image bearing member comprises an organic photoconductive layer.

73. A cartridge according to claim 71, wherein said image bearing member comprises an amorphous silicon photosensitive layer.

74. A cartridge according to claim 71, wherein said image bearing member is not exposed to light before it is charged by said charging means, after the image is transferred from said image bearing member to the transfer material.

75. A cartridge according to claim 63, wherein said charging member comprises a conductive rubber material.

76. A cartridge according to claim 63, wherein a center of vibration of the second vibratory voltage is zero.

77. A cartridge according to claim 63, further comprising means for developing an image on said image bearing member.

78. A process cartridge according to claim 63, wherein a center of the second voltage has the same polarity as that of the first voltage.

79. A process cartridge detachably mountable to an image forming apparatus, comprising:

a movable image bearing member on which an image is repetitively formed;

a charging member contactable to said image bearing member to charge it for formation of an image thereon, said charging member being supplied with voltages;

wherein said charging member also functions as a discharging member for discharging said image bearing member, and when said charging member charges said image bearing member, said charging member is supplied with a first voltage, and when said charging member functions as the discharging member, said charging member is supplied with a second voltage, and wherein said first and second voltages are vibratory voltages, and a peak-to-peak voltage of each of the vibratory voltages applied to said charging member is not less than twice an absolute value of a charge starting voltage of the image bearing member.

* * * * *

UNITED STATES PATENT AND TRADEMARK OFFICE

CERTIFICATE OF CORRECTION

PATENT NO. : 5,164,779

DATED : November 17, 1992

INVENTOR(S) : ARAYA, ET AL

It is certified that error appears in the above-indentified patent and that said Letters Patent is hereby corrected as shown below:

COLUMN 2

Line 3, "otherwise" should read --Otherwise,--.

Line 14, "photosensitive" should read --the photosensitive--.

Line 15, "may," should read --may--.

Line 23, "of the" should be deleted.

COLUMN 3

Line 57, "the a" should read --the--.

COLUMN 4

Line 28, "voltage Vdc" should read --voltage $V_{DC}$--.

COLUMN 5

Line 2, "cleaning 6" should read --cleaner 6--.

Line 59, "photo-sensitive" should read --photosensitive--.

Line 63, "or" should read --of--.

Line 64, "of" should read --or--.

COLUMN 6

Line 20, "remained" should read --remains--.

UNITED STATES PATENT AND TRADEMARK OFFICE

CERTIFICATE OF CORRECTION

PATENT NO. : 5,164,779

DATED : November 17, 1992

INVENTOR(S) : ARAYA, ET AL.

It is certified that error appears in the above-indentified patent and that said Letters Patent is hereby corrected as shown below:

COLUMN 7

Line 19, "core metal 12 a" should read --metal core 12--.

Line 29, "photosensitive member 3" should read --photosensitive drum 3--.

COLUMN 9

Line 22, "crosses" should read --cross--.

Line 24, "dic" should read --tic--.

Line 43, "law," should read --law--.

COLUMN 10

Line 1, "resulted" should read --resulting--.

Line 29, "levels of" should read —level is—.

Line 48, "charged" should read --is charged--.

COLUMN 11

Line 56, "agrees" should read --agrees with--; and "above described" should read --above described--.

Line 59, "make" should read --makes--.

COLUMN 12

Line 16, "ences" should read --ence--.

Line 44, "low" should read --law--.

UNITED STATES PATENT AND TRADEMARK OFFICE

CERTIFICATE OF CORRECTION

PATENT NO. : 5,164,779

DATED : November 17, 1992

INVENTOR(S) : ARAYA, ET AL.

It is certified that error appears in the above-indentified patent and that said Letters Patent is hereby corrected as shown below:

COLUMN 13

Line 19, "photosensitive member" should read --photosensitive drum 3--.

Line 64, "satisfied." should read --is satisfied.--.

COLUMN 14

Line 20, "VDC (-100V)" should read --$V_{DC}$ (-100V)--.

Line 21, "of" (first occurrence) should be deleted.

Line 39, "$Vpp \geqq 1|V_{TH}|$" should read --$Vpp \geqq 2|V_{TH}|$--.

COLUMN 15

Line 5, "FIG. 2" should read --the FIG. 2--.

Line 13, "photosensitive 3" should read --photosensitive drum 3--.

Line 23, "this" should read --these--; and "photo-sen" should read --photosen- --.

Line 56, "photo-sensitive" should read --photosensitive--.

COLUMN 16

Line 4, "used" should read --may be used--.

Line 8, "used" should read --was used--.

Line 33, "post discharging" should read --post-discharging--; and "post dis-" should read --post-dis- --.

COLUMN 17

Line 38, "claim 1," should read --claim 2,--.

UNITED STATES PATENT AND TRADEMARK OFFICE

CERTIFICATE OF CORRECTION

PATENT NO. : 5,164,779

DATED : November 17, 1992

INVENTOR(S) : ARAYA, ET AL

It is certified that error appears in the above-indentified patent and that said Letters Patent is hereby corrected as shown below:

COLUMN 18

Line 17, "means;" should read --member;--.
Line 19, "member" should read --means--.
Line 39, "claim 19," should read --claim 17,--.
Line 42, "charging" should read --said charging--.

COLUMN 19

Line 18, "whose value" should read --whose absolute value--.
Line 31, "claim 18, should read --claim 28--.
Line 40, "claim 1 or 30," should read --claim 2 or 29,--.

COLUMN 20

Line 56, "Ac voltage" should read --AC voltage--.
Line 61, "means" should read --means during--.

COLUMN 21

Line 18, "mean sin" should read --means in--.
Line 45, "applies" should read --applied--.
Line 51, "Ac voltage" should read --AC voltage--.
Line 60, "charging" should read --said charging.

Signed and Sealed this

Fourth Day of October, 1994

*Attest:*

*Attesting Officer*

Bruce Lehman

BRUCE LEHMAN

*Commissioner of Patents and Trademarks*